United States Patent [19]

Casutt

[11] Patent Number: 4,621,484

[45] Date of Patent: Nov. 11, 1986

[54] METHOD OF MAKING A FOLDED UP EGG PACK

[76] Inventor: Toni Casutt, Blumenrain 24, CH-8702 Zollikon, Switzerland

[21] Appl. No.: 737,826

[22] Filed: May 24, 1985

[30] Foreign Application Priority Data

May 25, 1984 [CH] Switzerland ..... 2578/84

[51] Int. Cl.[4] ..... B65B 23/04

[52] U.S. Cl. ..... 53/456; 53/263; 493/92; 493/913

[58] Field of Search ..... 53/456, 452, 491, 476, 53/375, 376, 377, 263; 493/129, 151, 133, 913, 92

[56] References Cited

U.S. PATENT DOCUMENTS

| | | | |
|---|---|---|---|
| 3,249,024 | 5/1966 | Shiu | 53/375 X |
| 3,983,680 | 10/1976 | Casutt | 53/397 |
| 4,132,346 | 1/1979 | Casutt | 229/28 R |
| 4,387,549 | 6/1983 | Casutt | 53/456 |
| 4,480,421 | 11/1984 | Rece | 53/383 X |

*Primary Examiner*—James F. Coan

*Attorney, Agent, or Firm*—Frishauf, Holtz, Goodman & Woodward

[57] ABSTRACT

In an egg box made from slitted cardboard blanks of which one provides wave strips joined only at their wave crests for folding around to make pockets for the eggs and the other blank provides flat bottom and side panel or cover strips which brace the wave strips by being glued to the wave trough bottoms of the wave strips, top cover strips respectively glued to the half width wave strips that come together (when the top wave strips are folded around the eggs already packed in the pockets previously formed,) do not both correspond in width to the top wave strips, but one of them has an overlapping free edge the underside of which is bonded adhesively to the other top panel strip. The adhesive bonding is done with a hot-sticking adhesive which when cooled without being covered is no longer sticky. The adhesive is laid down in strips on the wider and shorter blank which provides the cover strips at locations corresponding to the wave trough bottoms that are to be glued on. While it is hot the longer and narrower wave blank, bent into waves, is glued on, leaving the edge portion of the wider blank with spaced cross-ribbons of adhesive which are allowed to cool so that they are no longer sticky. The glued blanks are then filled at a packing station but before they are folded to make pockets, for the eggs, the free edge strip is heated with hot air to soften the adhesive ribbons and then the box is set up and filled and after the top of the box is folded into place, the overlapping free edge strip is pressed against the underlying cover strip to stick the two together. When the adhesive has cooled the pack is secured.

3 Claims, 5 Drawing Figures

METHOD OF MAKING A FOLDED UP EGG PACK

This invention concerns the method for making an egg pack of the fold-up type constructed of strips bent in flattop wave shape and are joined together at the wave crests braced by external flat strips to which they are glued at their flat wave troughs, the entire pack being made of out two originally cardboard blanks, from one of which the cover strips are made the other of which the wave strips are made.

The basic construction of an egg pack of the kind to which the present invention applies is described in my issued U.S Pat. Nos. 3,955,744, 3,983,680 and 4,387,549. Although the success of these eggs packs has been confirmed by their accpetance in the market, the securing of the complete pack closed up after filling the partly erected pack with eggs, has left much to be desired regarding the efficiency of the packing process. The problem is that either the two oppositely abutting parts of the pack that are brought together in closing it must be connected together along their line of abutment with an adhesive or an adhesive tape or else tongues or tabs bent out of the cardboard pack material must be bonded by adhesive to the abutting cover strips over which they are folded as shown in my U.S. Pat. No. 4,132,346.

SUMMARY OF THE INVENTION

It is the object of the present invention to provide a new process for making a new version of an egg pack of the general kind above described, in which the bonding and securing of the completely set up egg pack can be carried out in a manner that is particularly simple, efficient and quick.

Briefly, the first or shorter-length blank providing the cover strips is made broader than the second blank from which the wave strips are made, so that a free edge strip extending acorss the boundary between the wave strips brought together when the pack is closed can overlie the other top cover strip and be bonded thereto. The interior (under) side of the edge strip has a hot-sticking adhesive applied to it at least at locations spaced along its length which, at the time the gluing was done, had been allowed to cool. For closing of the pack this cooled and no longer sticky adhesive is made sticky by heating. The outer wave strips of the combined blanks and their flat cover strips paths are bent around to bring the wave strips together while the overlapping edge portion extending laterally from one of the top cover strips overlies the narrower top cover strip and becomes bonded thereto to complete a securely closed pack.

By the method as summarized, it is possible at the packing station—i.e. where the eggs are inserted into the pack—to carry out the necessary operations to simplify the equipment, since it is sufficient at this station to reheat the adhesive at the locations on the free edge strip extending laterally beyond the combined parts of the blanks, fold and fill the pack, and then to lay the two parts to be bonded together one over the other and briefly to press against them, because the hot-sticking adhesive cools very quickly forming the bond. This is particularly advantageous because in this way no adhesive-applying apparatus is needed at the egg packing station and no heating up time at the beginning of work or possibility of the stopping up of the applying nozzles or risks of smearing need to be allowed for at the egg packing station.

Compared with other adhesives, hot-sticking adhesives have the advantage that immediately after cooling of the place of sticking the full bond strength of the adhesive bond is obtained, so that a rapid rhythm of operations is attainable. The previously prepared cold patches or stripes of hot-sticking adhesive on the empty packs have the advantage that the manufacture of the empty packs can take place at a central place in large quantities and thereafter the distributed egg packing stations widely distributed locations without the packs in their emply condition sticking to each other.

By the overlapping closure parts the pack is made stiffer and more stable against twisting, thereby reducing the risk of breaking the eggs. Furthermore the outer surfaces, in contrast to stamped out tongues bent over the abuttment line of the edges to be joined - are not interrupted, which facilitate the application of easily readable inscriptions or even pictures on the outer surfaces of the egg pack.

BRIEF DESCRIPTION OF THE DRAWINGS

The invention is further described by way of illustrative example with reference to the annexed drawings, in which.

DESCRIPTION OF THE ILLUSTRATED EMBODIEMENT

Figure 1:
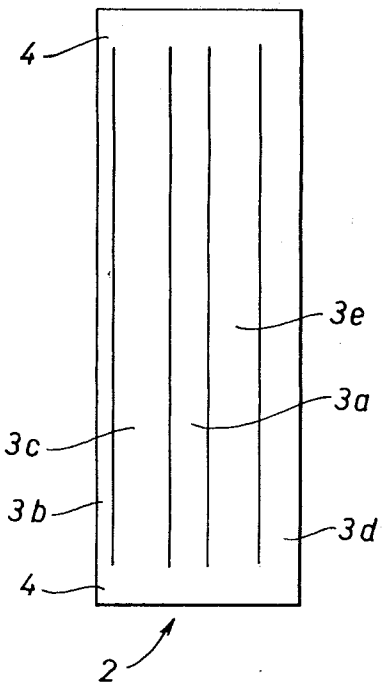
FIG. 1 is a plan view of a first cardboard blank from which the outer sides of the egg box are eventually to be formed.

The first blank 2 shown in FIG. 1, stamped out of cardboard or the like, is for external cover strip of the egg box and accordingly will usually be printed already. This flat blank 2 is composed of five parallel strips 3*a*, 3*b*, 3*c*, 3*d*, 3*e* running lengthwise of the blank which remain connected to each other only at the cross strips 4 provided at both ends.

The middle strip 3*a* is twice as wide as one of the outermost strips, the strip 3*b*. The other of the outermost strips, the strip 3*b*, is at least approximately equal in width to the middle strip 3*a*. The two strips immediately to the left and right of the middle strip 3*a*, namely the lengthwise strips 3*c* and 3*e*, are in each case wider than the middle strip 3*a*. The blank 2 may be made, for example, by unwinding from a roll, separating the individual length by cutting them off sequentially and then slitting the separate blanks to form the lengthwise strips.

Figure 2:
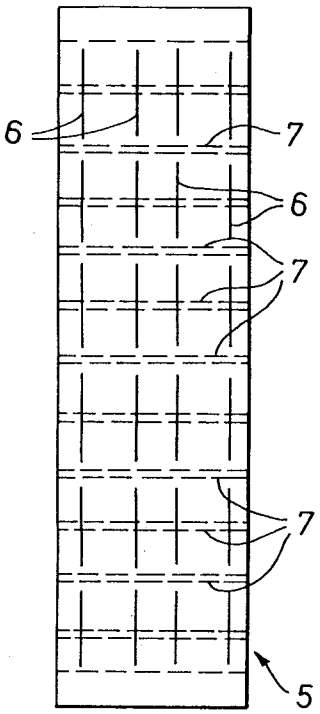
FIG. 2 is a plan view of a second cardboard blank from which the wave strips are to be formed.

A second slitted blank, shown in FIG. 2, is cut from another roll of cardboard or from a flat sheet of cardboard. The blank 5 is longer but narrower than the blank 2. At the same time as this blank is cut from the roll or in a following operation intermittent slits 6 running in the lengthwise direction are made in the blank 5. These slits extend along parallel lines and each case they are interrupted between two crosswise running bending edges 7 which will later form the wave hollows and wave crests. These bending lines 7 are scored, perforated, indented or otherwise weakened, so that the blank can easily bend at these places for forming the wave. The bending edges 7 are in pairs spaced, for example, 6 mm. apart. They may generally referred to as "scored" to mean that they are scored, perforated, indented or otherwise weakened.

Figure 3:
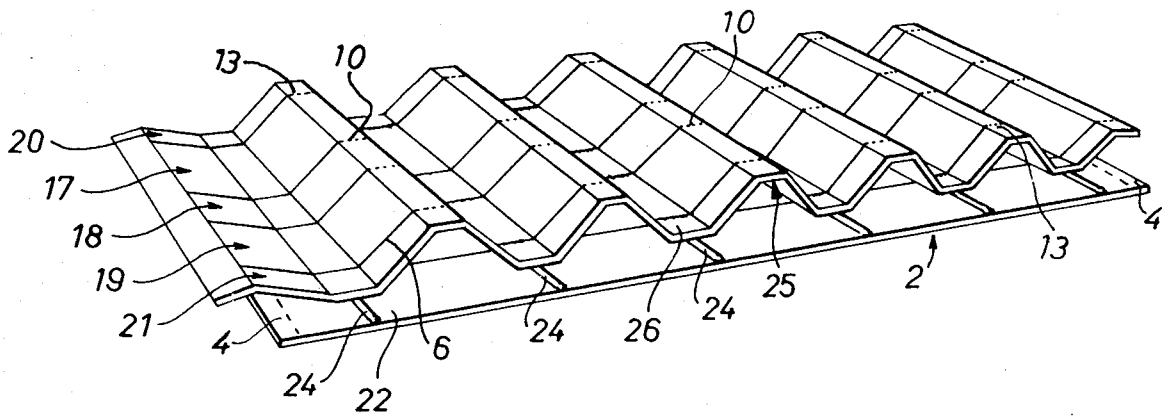
FIG. 3 is a perspective view of a wave strip shaped out of the second cardboard blank after it is connected to the first cardboard blank.

Waves such as shown in FIG. 3 are then formed in the second blank 5, producing narrow, flat wave crests 25 and wave hollows 26 while running trasverse to the length direction of the two blanks 2 and 5. The blank 5, which is longer in its flat condition than the first blank 2 is shortened by the provision of the waves.

Then follows the bonding, by adhesive, of the first blank 2 with the wave-shaped blank 5, which is performed by first applying a coating of a hot-sticking adhesive in the form of adhesive strips 24 or equivalent adhesive beads. If the filling of the boxes with eggs does not take place in the same continuous sequence of operations as the manufacture of the egg pack, the waves can be folded flat to save transport bulk, resulting in a texture of scaled appearance. In order that the scales can be folded flat as possible, particular dimensional relations for the waves need to be observed, as is known from U.S. Pat. No. 4,387,549.

When the bonding of the wave strip is performed, undesired bonding of the lengthwise strips 3*a*, 3*b*, 3*c*, 3*d*, 3*e* may appear upon the lengthwise slits 6 in the blank 2 as a result of residual adhesive. In order that such undesired sticking should not later disturb the erection of the egg pack, they are broken at this stage, which may be done by either slightly arching them up under the wave structure perpendicularly to its length direction, thus breaking up individual adhesions between neighboring strips or by leading the structure, with the waves flattened in a scale like pattern, between rollers disposed one above the other which are so mounted that a height offset is produced and, in consequence thereof, the undesired adhesions are broken up.

After the bonding together of the two blanks the cross stips 4 are no longer necessary, these being provided only for holding together the individual lengthwise strips 3*a*–3*e* before bonding with the wave strip. The cross strips are then cut off at both ends at this stage of manufacture.

As can be seen in FIG. 3, there are produced five support racks 17, 18, 19, 20 and 21 each consisting of a flat cover strip and a wave strip. These support racks are connected together only at the wave crests. Dotted lines in FIG. 3 show connection locations which eventually will be bending edges 10 and 13. The adhesive strips or coatings extend in straigt line from the glued wave strip portion over the edge strips 24.

Figure 4:
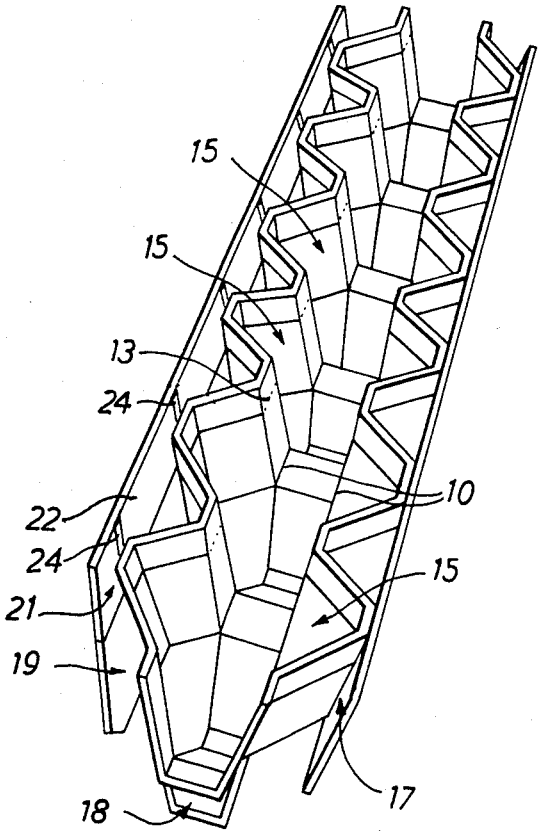
FIG. 4 is a perspective view of the partly erected egg box ready for insertion of the eggs.

To prepare for inserting the eggs 28 in the box pack, the pack is first partially erected in the manner shown in FIG. 4. The support racks 17 and 19 are then bent up in each case by an angle of approximately 90 degrees about the bending edges 10 (FIG. 4) so that a structure more or less "U" shaped in cross section is produced in which the middle support rack is located below, and pockets 15 are formed that are open upwards.

Figure 5:
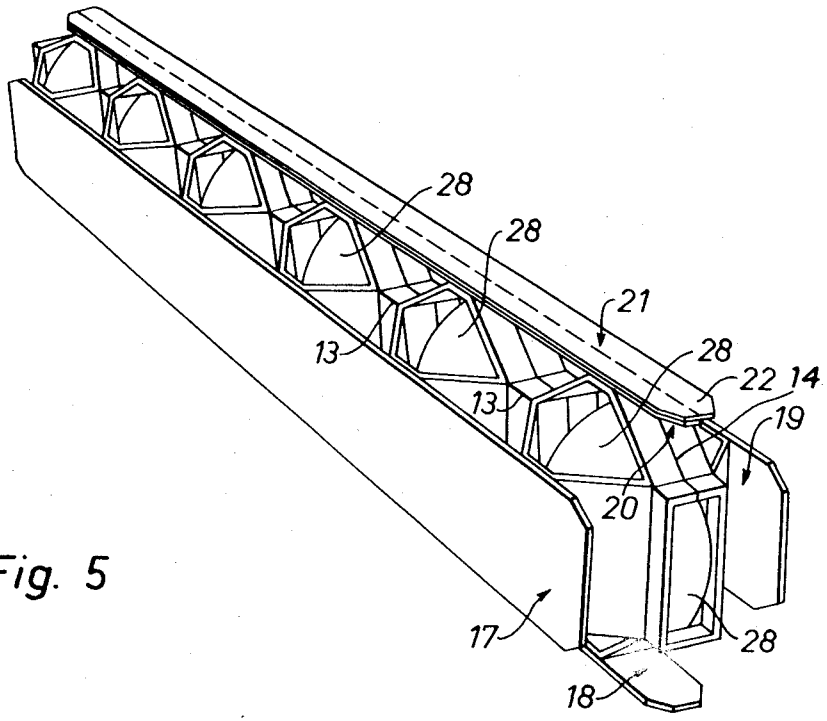
FIG. 5 is a perspective view of the completely erected egg box, as bonded together with adhesive.

The box pack preformed as above described is held in the position just described in a mechanical holder. Then the eggs 28 which are to be inserted from above are laid into the pockets formed by oppositely facing wave hollows and then are further displaced rhythmically in a direction transverse to their length. Then the two upper support racks 20 and 21 are swung around about the lengthwise bending edges 13 towards each other, in each case by about 90 degrees, so that configuration of the pack shown in FIG. 5 is finally produced. Before the bending around of the support racks 20 and 21, the adhesive strips 24, or equivalent beads previously provided on the edge strips 22 are heated, for example, by hot air or by electric heating units, to produce the necessary sticking capability. The heating of these adhesion locations is performed before the closing stroke applied to the pack. The bending around of the two support racks 20 and 21 takes place in such a way that the edge strip 22 projecting above the support rack 21 comes to lie on top of the support rack 20. Thus, the adhesive strip 24 is put against the underlying cover strip and comes to lie against it. Consequently the edge strip 22 and the cover strip of the support rack 20 are bonded together by the adhesive.

In this condition the neighboring support racks 20 and 21 are brought tightly one against the other although separated by the separating cut 14 between them. For a least a short time the overlapping strips are placed together at the adhesive location, this being preferably performed with several forceps-like clamping devices until the adhesive has cooled.

As a result of the above operations the egg box is closed around the eggs and is now along with its contents, in a condition ready for sale. At this point, however, it may be appropriate to apply a date stamp or the like to the filled box.

Although the invention has been described with respect to a particular illustrative example, it will be understood that variations and modifications are possible within the inventors concept.

The expression "gluing " is sometimes used herein to describe that attachment of the wave strips to the cover or panel strips, even though the adhesive most preferably used in the same heat-sticking adhesive that can in exposed places cool on a surface that is not even tacky, which adhesive may not strictly be "glue". This corresponds to use of the word "scoring" to mean weakening of cardboard along a line whether by identation, spaced perforations or otherwise.

I claim:

1. Method of making, out of cardboard blanks, a pack for eggs or other fragile articles, comprising the steps of:

cutting and slitting a first blank with parallel slits defining external cover strips for said pack, joined together in said first blank only at their ends, by cross strips;

cutting, slitting and scoring a second blank, longer and narrower than said first blank, with parallel lengthwise interrupted slits for forming wave strips joined laterally at their wave crests along scored boundaries, said wave strips of said second blank including a bottom wave strip in the center of said second blank, side wave strips laterally adjoining said bottom wave strips in said second blank and top wave strips, each having half the width of said bottom wave strip, running along the respective side edges of said second blank laterally adjoining the respective side wave strips, said cover strips of said first blank including, in a mid-portion of said first blank, strips respectively corresponding in width and relative position to said bottom and side wave strips of said second blank, a cover strip at first side edge of said first blank corresponding in width to one of said top wave strips of said second blank and a second cover strip at the second side edge of said first blank having a width sufficient to include a first cover portion of a width corresponding to one of said top wave strips of said seocnd blank for bracing said top wave strip and a second free edge portion extending laterally beyond said first cover portion to said second side edge of said first blank, for ultimately overlapping the cover strip at said first side edge portion of said first blank shaping said wave strips;

applying a hot-sticking adhesive in crosswise ribbons or beads on said first blank in locations pre-selected for gluing said wave strips of said second blank to said cover strips of said first blank to form separating support racks for pack contents, which racks are respectively braced on corresponding cover strips of said first blank, and at the same time applying hot-sticking adhesive to said free edge cover strip portion by extending said crosswise ribbons or beads of adhesive across the entire width of said first blank gluing said wave strips of said second blank to said cover strips of said first blank by bending said second blank along crosswise scoring thereof to form flat wave hollows and wave crests, superimposing flat wave hollows defined by scoring and bending of said second blank on said ribbons or beads of adhesive on said first blank while said adhesive confined between said first blank and said wave hollows of said second blank is hot, followed by cooling whereby a nonsticking state of adhesive on said free edge cover strip portion is assured;

cutting off said cross-strips of said first blank to separate said cover strips;

folding said side wave strips at substantially 90 degrees relative to said bottom wave strip on lengthwise scoring of said second blank to form pockets defined by rack structures by said bottom and side wave strips;

inserting eggs or other fragile articles in said pockets;

applying heat to warm said adhesive on said free edge cover-strip portion and make it sticky for bonding;

folding said top wave strips relative to said side wave strips at substantially 90 degrees on lengthwise scoring of said second blank to enclose said pockets, and holding the side cover strips to bring said top wave strips together while pressing said free edge portion of said first blank, having said hot-sticking adhesive applied thereto, over and against the top cover strip originally located at the opposite lateral edge of the first blank and then allowing the adhesive to cool and to establish a bond before releasing to completed pack.

2. Method acording to claim 1, in which after the step of gluing said wave strips of said second blank to said first blank a temporary deformation of the gluded blanks is performed to break possible unintended adhesions between neighboring wave strips that might interfere with the steps of 90° folding of said wave strips with respect to each other.

3. Method according to claim 1, in which after the step of cutting off of said cross strips of said first blank said wave strips are folded flat against said cover strips to produce a scale-like configuration of said wave strips for subsequent transportation or storage intervening before performance of the remaining steps of the method.

* * * * *